US005730293A

United States Patent [19]

Kelly et al.

[11] Patent Number: 5,730,293

[45] Date of Patent: Mar. 24, 1998

[54] PRODUCT AND KIT FOR SCULPTING TREATED SAND AND METHOD THEREFOR

[76] Inventors: Michael J. Kelly; Brynda L. Kelly; Kari M. Kelly, all of 8170 Leeshore Dr., Maineville, Ohio 45039

[21] Appl. No.: 539,100

[22] Filed: Oct. 4, 1995

[51] Int. Cl.[6] ..... A63H 33/32

[52] U.S. Cl. ..... 206/575; 206/579; 220/665; 446/70; 434/84

[58] Field of Search ..... 206/575, 576, 206/223, 579, 553, 349, 805; 220/662, 665, 373; 446/70, 475; 434/84

[56] References Cited

U.S. PATENT DOCUMENTS 3,447,256 6/1969 Compton ..... 446/70

OTHER PUBLICATIONS

Amazing Activity Sand—Quick sand—Toy Fair—New York city, Feb. 16, 1996.

*Primary Examiner*—Paul T. Sewell

*Assistant Examiner*—Luan K. Bui

*Attorney, Agent, or Firm*—Timothy J. Martin; Michael R. Henson

[57] ABSTRACT

A product for use in creating sculpted shapes and features comprises a dry quantity of granular sand which is treated to retain its cohesiveness when submerged in water. A compressible receptacle contains the granular sand in a hollow interior thereof, and this receptacle includes a longitudinally extending sidewall surrounding the interior, a closure forming an upstream end of the receptacle and a dispensing nozzle disposed at a downstream end. The nozzle has a mouth sized to be larger than the granular size of the sand and in fluid communication with the interior. The sidewall is fabricated from a material having sufficient flexibility to allow the receptacle to be squeezed with enough force to cause a cohesive mass of the sand to be forcibly extruded out of the mouth when the nozzle is immersed within a volume of water. A sculpting kit is also provided which further includes a container sized and adapted to include items such as the filled receptacle, an ensemble of tools, a refilling implement and a filter.

25 Claims, 5 Drawing Sheets

PRODUCT AND KIT FOR SCULPTING TREATED SAND AND METHOD THEREFOR

FIELD OF INVENTION

The present invention is directed to a product adapted for use in creating sculpted shapes and features from treated sand which retains its cohesiveness when submerged in water. The present invention more particularly concerns a sculpting kit containing a variety of the elements necessary for creating sculpted shapes and features from treated sand. A method of sculpting such shapes and features is also provided.

BACKGROUND OF THE INVENTION

Children of all ages have long been intrigued by activities which stimulate the imagination. The creativity of a young mind can foster exploration of times and places which are otherwise inaccessible. In order to create a more realistic setting for play, it is useful to have a staging arena for the make believe. The toy industry has long been cognizant of this. Some companies, in fact, encourage the creative process by providing the necessary implements for the child to design and build his or her own structures. Construction sets, molding materials and building blocks are only a few examples of toys which make up a typical child's repertoire.

Activities which specifically involve the use of water are very popular attractions among children because the children are able to do things they could not ordinarily do, such as make mud pies or engage in water balloon fights. Many individuals, for example, have vivid recollections of erecting various structures out of sand as miniature replicas of such things as castles, houses or forts. Whether these nostalgic experiences come from vacations on the beach or times of amusement in one's own sandbox, the attraction is the same. This activity allows a child to manipulate the sand into forms which are unique and often intricate in design. The resulting structure has no precedent and is purely a product of the child's imagination.

One of the appeals of constructing forms from sand is in its simplicity. The sand is mixed with water in a pail so that it is damp and thereafter sculpted into the desired forms. For the simplest of designs, the pail serves a dual purpose in that it also provides a mold for the various structural features. For more intricate designs, sculpting tools can be used to shape the sand. One of the drawbacks of sand sculpting is that the sculptures do not retain their shape under water and are prone to collapse once the sand dries. However, it has been found that sand can be treated so that it has a non-wettable property and retains its cohesiveness when submerged in water. An example of such a treated sand material has been sold in the past under the name "MAGIC SAND" by WHAMO®. Among the various characteristics of this treated sand material is that, when it is placed in the bottom of a container and covered with a low level of water, a user can write or draw on it.

Children are also fascinated and intrigued by the unusual and the seemingly unexplainable. Who can forget spending hours as a youngster with a chemistry set making the impossible happen, or watching in amazement as a magician performs a magic trick which seems to defy reality. The present invention uniquely combines these aspects which so enthuse today's youth by allowing them to use their imagination to create sculpted forms out of treated sand. The present invention further has those magical qualities in that the sand is able to retain its sculpted form only when immersed in water.

SUMMARY OF INVENTION

It is an object of the present invention to provide a new and useful product for use in sculpting various shapes and features out of treated sand which is immersed in water.

Another object of the present invention is to provide a new and useful sculpting kit which contains a variety of the elements necessary to sculpt various shapes and features out of treated sand which retains its cohesiveness in water.

A further object of the present invention is to provide a methodology for sculpting the various shapes and features out of treated sand that is stored in a container.

A still further object of the present invention is to provide a sculpting kit which is self contained to allow for convenient storage when the kit is not being used.

Yet another object of the present invention is to provide a new and useful product which stimulates a child's imagination and provides hours of enjoyment during play.

Still another object of the present invention is to provide a new and useful sculpting product which is confined for use in water play.

A final object of the present invention is to provide a reusable sculpting kit so that a child may conveniently resume play at a later time without the need to replace parts.

To accomplish these objectives, a product is provided which is adapted for use in creating sculpted shapes and features. The product comprises a compressible receptacle having a hollow interior and including a longitudinally extending sidewall surrounding the interior. A closure forms an upstream end of the receptacle and a dispensing nozzle is formed at the downstream end of the receptacle which is in fluid communication with the interior. A dry quantity of granular sand having a granular size is also provided and the sand is treated so that it retains its cohesiveness when submerged in water. The receptacle's nozzle has a mouth which is sized to be larger than the granular size of the sand. This treated sand is initially disposed in the interior of the receptacle. The receptacle's sidewall is fabricated from a flexible material so that, when its nozzle is immersed within a volume of water, the receptacle may be squeezed to dispense a cohesive mass of the treated sand through the nozzle in a downstream direction and into the water.

This sidewall is an elongated tubular member with its upstream end having either a circular or an elliptical cross-section. It is also preferred that the material from which the sidewall is formed be sufficiently flexible so that the receptacle may be compressed from an original state to a collapsed state where opposed inner surfaces of the sidewall contact one another, and thereafter returnable to the original state without violating the structural integrity of the sidewall. The nozzle extends longitudinally and is tapered in a longitudinal direction. It is preferred that the nozzle be severable thereacross at selected different locations to allow formations of mouths having different cross-sectional areas whereby the cohesive mass may be dispensed with different cross-sections.

A sculpting kit is also provided which is particularly adapted for use in creating the sculpted shapes and features. This kit broadly comprises, in combination, a container adapted to receive and retain a volume of water, a compressible receptacle and a quantity of the treated sand of a first color. The container is constructed from a transparent material and includes a base having a generally rectangular perimeter, a pair of opposed container end walls and a pair of opposed container sidewalls which project upwardly from the base to terminate at a rim to form an opening for the container. Preferably, each pair of container end walls and container sidewalls is upwardly divergent from one another.

The sculpting kit according to the present invention provides for a continuous loop elastic member, such as a rubber band, which is sized to extend completely around the container. This elastic member may be used in conjunction with a filter which is sized and adapted to be placed over an opening of the container. The filter is preferably formed of a material which is impervious to the treated sand, such as a flexible mesh material or a conventional paper towel, and the elastic member is used to retain the filter over the opening so that when water and the treated sand are disposed within the container, the water may be drained from the container through the filter while retaining the treated sand within the container.

Alternatively, a lid may be provided which is releasably securable to the container and is adapted to snap fit onto an outwardly protruding lip disposed along the container's rim. This lid, preferably, includes a viewing portion to allow the treated sand to be viewed therethrough during use. The lid may also be used in conjunction with a filter as discussed above so that, when the filter is placed between the container and the lid, the water may be drained from the container through the filter and a plurality of drain opening formed in the lid, while the treated sand is retained within the container.

A variety of other components can be added to complete the sculpting kit. For example, the kit may include an ensemble of tools which are suitable for sculpting a variety of different features in the sand. Preferably, this ensemble includes at least two different types of tools for sculpting at least two different types of features. These tools may be releasably connected together in a flat tree arrangement. The tools, receptacles and filter are each sized for insertion into the container for storage.

In addition, the sculpting kit may also include a refilling implement, such as a funnel, for transferring the treated sand from the container back into the receptacle after use. The refilling implement includes a first opening located at a first end thereof and a second opening located at a second end thereof. The first opening is enlarged relative to the second opening and is in fluid communication therewith. The second opening is sized for insertion into a mouth of the receptacle so that the treated sand may be poured from the container through the refilling implement and into the receptacle's interior.

To allow for added enjoyment, a second compressible receptacle is provided to store treated sand of a second color different from the first color. This second compressible receptacle is constructed similarly to the first compressible receptacle. The tools, elastic member, receptacle(s), filter and refilling implement are each sized for insertion into the container for convenient storage.

The methodology according to the present invention relates to sculpting shapes and features out of a quantity of granular sand having a granular size, wherein the sand retains its cohesiveness when submerged in water. Broadly, this methodology comprises the steps of providing at least one compressible receptacle having the characteristics described above, immersing the receptacle's nozzle below a surface level of the water, and thereafter squeezing the receptacle's sidewall with sufficient force to cause a cohesive mass of the granular said to be extruded through the nozzle in the downstream direction and into the water. The methodology may additionally include the step of filtering the water from the container and/or the step of manipulating a cohesive mass of the sand into a sculpted shape through the application of a sculpting tool.

These and other objects of the present invention will become more readily appreciated and understood from a consideration of the following detailed description of the exemplary embodiments of the present invention when taken together with the accompanying drawings, in which:

BRIEF DESCRIPTION OF DRAWINGS

FIG. 2(*b*) is a perspective view, partially broken away, of the receptacle in FIG. 1 and specifically showing a cohesive mass of treated sand being extruded therefrom as the receptacle is compressed;

DETAILED DESCRIPTION OF THE EXEMPLARY EMBODIMENTS

The present invention is directed to a product and kit adapted for use in creating shapes and features out of treated sand which is submerged in water. As such, the kit according to the present invention includes a variety of the elements necessary to make creative designs and provides hours of enjoyment for children of all age groups.

Figure 1:
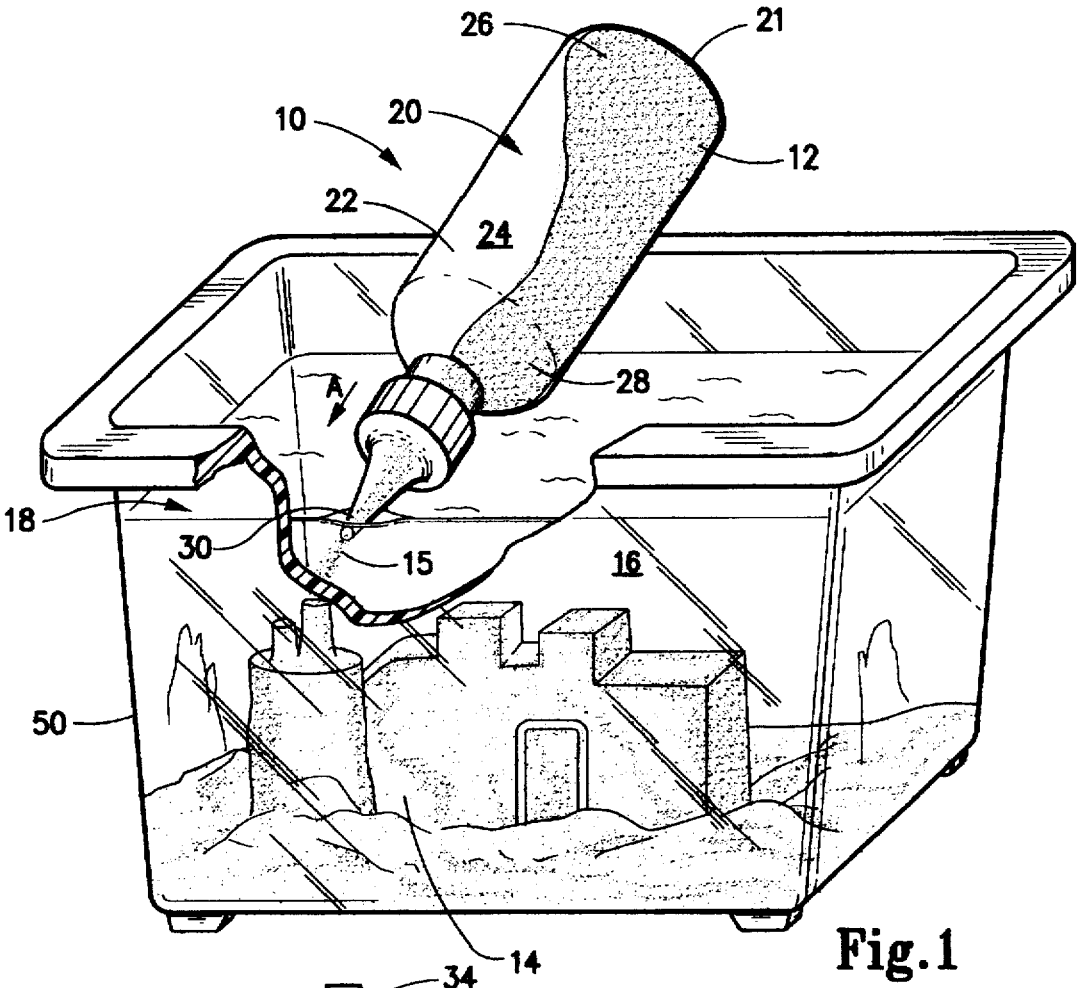
FIG. 1 is a perspective view of a container of water which is partially broken away to show a sculpting product according to the present invention in use as applied to form a desired shape or feature out of treated sand that is submerged in the water.

FIG. 1 shows a sculpting product 10 according to the present invention as used to create desired shapes and features, shown here as sandcastles 14, out of treated sand 12. This treated sand 12 is essentially a non-wettable granular substance which retains its cohesiveness when submerged in water. Sculpting product 10 is used in conjunction with a container 50 which serves as a reservoir for receiving and retaining a volume of water 16. product 10 generally includes a compressible receptacle 20 and the treated sand 12 which is initially contained therein. Receptacle 20 includes a longitudinal sidewall 22 which extends between a closure 21 forming an upstream end 26 of receptacle 20 and a dispenser, shown as nozzle 30, which forms a downstream end 28 of receptacle 20.

In order for some of the treated sand 12 not to float on the surface 18 of the water 16 when product 10 is in use, it is necessary to immerse nozzle 30 below the water's surface level 18. Receptacle 20 may then be compressed to extrude a cohesive mass 15 of the treated sand 12 through nozzle 30 in a downstream direction (arrow "A") and into water 16. However, it is possible to submerge treated sand 12 without having to immerse nozzle 30 below surface level 18. This can be done be either by extruding an adequate amount of treated sand 12 onto surface level 18 or by extruding treated sand 12 from the receptacle 20 with enough momentum to force it below surface level 18.

In the past, treated sand 12 has been stored in a rigid receptacle from which it was dispensed by pouring. The quantity of sand dispensed, however, was difficult to control. It has now been surprisingly found that the ability to extrude treated sand 12 through a dispensing nozzle, such as nozzle 30, allows for better control of the quantity extruded and, thus, facilitates sculpting.

Figure 2A:
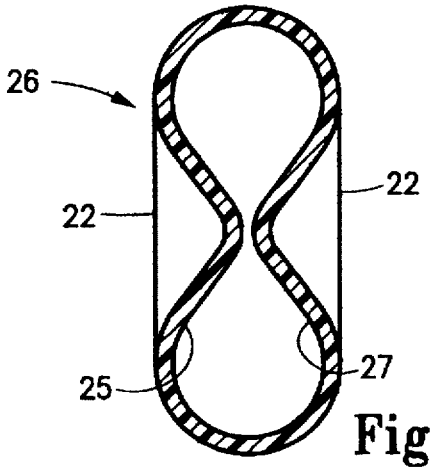
FIG. 2(*a*) is a cross-sectional view of the receptacle in FIG. 1 showing the contact of the opposed inner surfaces as the sidewall is compressed.
Figure 2B:
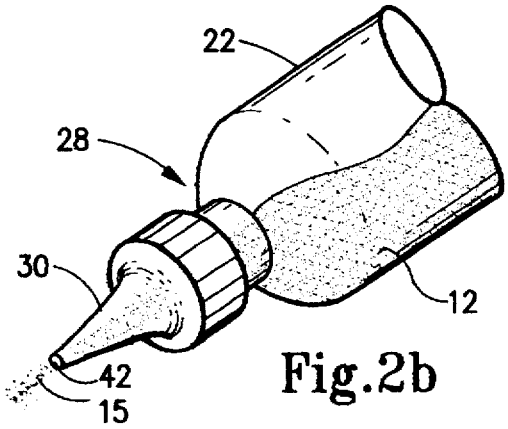

As shown in FIGS. 2(*a*) and 2(*b*), upstream end 26 may be elliptical in cross-section and sidewall 22 is preferably formed from a material that has sufficient flexibility such that, as receptacle 20 is compressed to dispense cohesive mass 15, opposed inner surfaces 25 and 27 of sidewall 22 may come into contact with one another to force the treated sand 12 out of receptacle 20 in the downstream direction, through the nozzle's mouth 42, without violating the structure integrity of sidewall 22. It has been found that receptacle 20 should only be about one-half (½) to three-fourths (¾) full with treated sand 12 to allow for proper compression and extrusion of the treated sand 12 therefrom.

Figure 3:
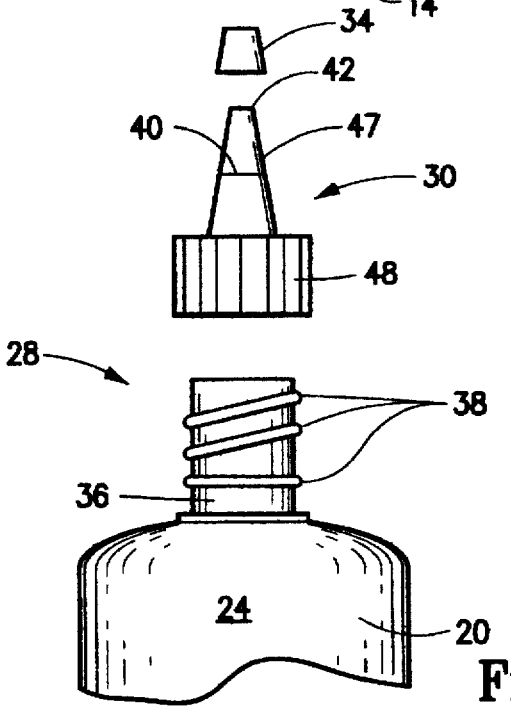
FIG. 3 is an exploded side view, in elevation, of the downstream end of a receptacle according to the present invention.
Figure 4:
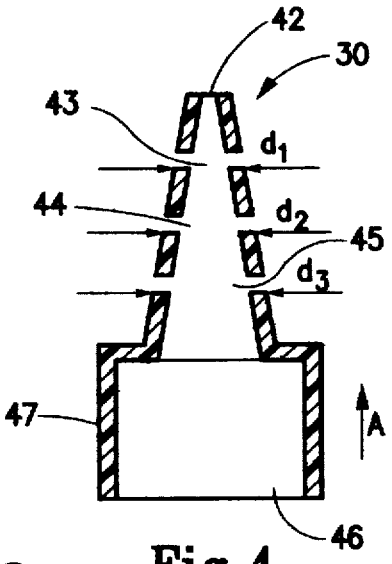
FIG. 4 is a cross-sectional side view showing the severability of the nozzle for the receptacle in FIG. 1.

A preferred construction for downstream end 28 of receptacle 20, and specifically nozzle 30, is shown in FIGS. 3 and 4 wherein it may be seen that receptacle 20 includes a neck 36 having a plurality of ribs 38 which are adapted to releasably engage a nozzle screwcap 48 so that nozzle 30 may be attached to receptacle 20. Nozzle 30 has an outer nozzle wall 47 which surrounds an interior passageway 46. Passageway 46 is in fluid communication with interior 24 of receptacle 20 and tapers in the downstream direction to terminate at open mouth 42. Nozzle 30 is constructed of a material that is preferably severable transversely to the downstream direction at several different locations to allow for formation of mouths 43, 44 and 45 which have different diameters, (identified as d1, d2, and d3), and, thus, different cross-sectional areas. This feature conveniently permits extrusion from receptacle 20 of a cohesive mass 15 having different cross-sectional areas. One of ordinary skill should readily appreciate that this would be a desirable feature to have in order to sculpt features of different sizes out of treated sand 12. The skilled artisan should also appreciate that the construction of receptacle 20 need not be unnecessarily limited to that described herein. Rather, receptacle 20 could take on a variety of different configurations provided it is adapted to adequately store treated sand 12 and extrude the sand therefrom through a nozzle 30 and into water 16.

Figure 5:
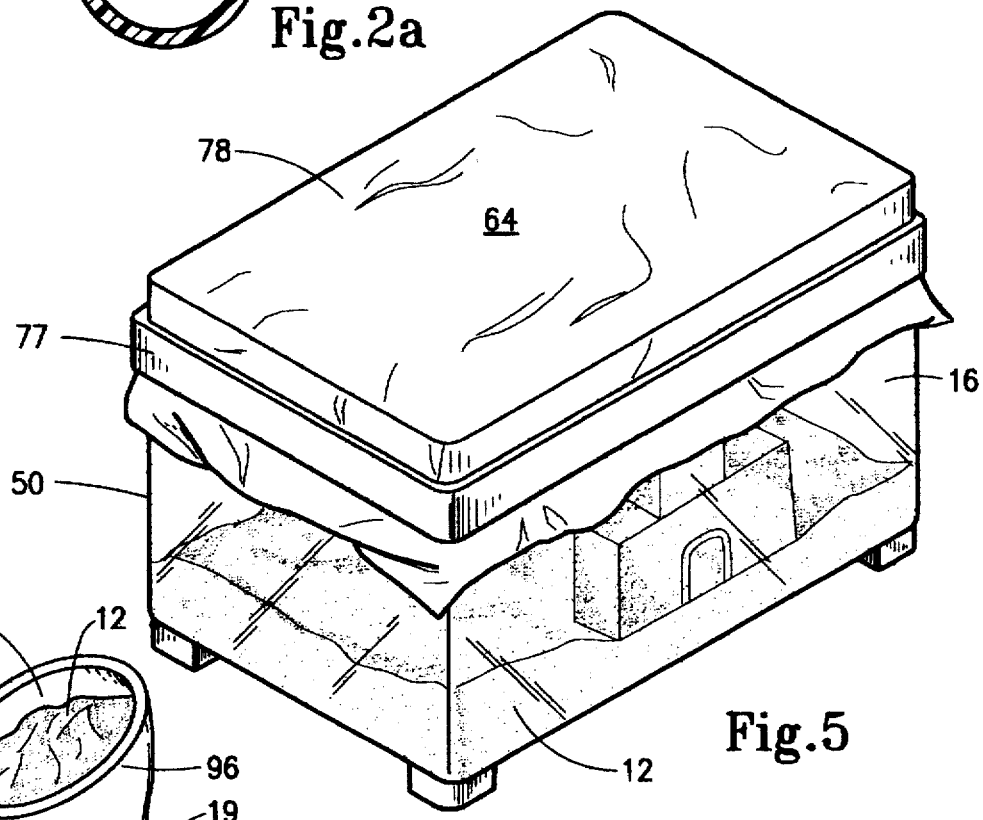
FIG. 5 is a perspective view of a container according to the present invention, showing an elastic member extending therearound to secure a filter over the container's opening.

Once the user is finished sculpting the various shapes and features out of treated sand 12, it is important to have a simple, yet effective way of cleaning container 50 with as little mess as possible. FIG. 5 shows that a continuous loop elastic member 77 may be placed around container 50 to secure an appropriate filter 78, shown here as a household paper towel which is impervious to treated sand 12, over an opening 64 of container 50. With filter 78 secured, container 50 may then be inverted so that only water 16 is drained therefrom, while the treated sand 12 is retained within container 50. Any left over water 16 within container 50 can then be soaked up with the paper towel. Other accessories may also be used to drain water 16 from container 50, and these are discussed below with particular reference to FIG. 7.

Figure 6:
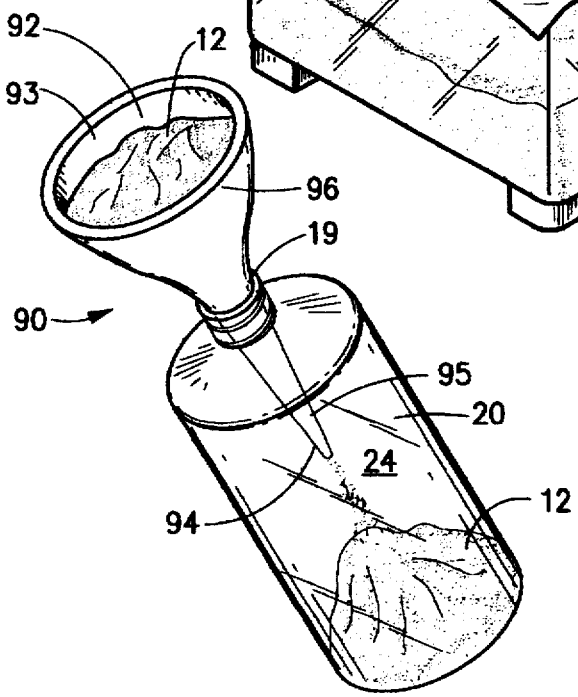
FIG. 6 is a perspective view of the receptacle in FIG. 1, without the nozzle member attached, as shown in use with a refilling implement.

It is desirous to save for later use as much of treated sand 12 as possible after water 16 has been drained from container 50, as discussed above. Accordingly, in FIG. 6 a refilling implement 90 is provided which may be used in conjunction with receptacle 20 for transferring the treated sand 12 back into receptacle 20. Refilling implement 90 is preferably a conventional funnel-shaped member which includes a first opening 92 located at a first end 93 and a second opening 94 located at a second end 95. Second opening 94 is in fluid communication with first opening 92. Refilling implement 90 has an outer sidewall 96 that is tapered in construction from first end 93 to second end 95 so first opening 92 is enlarged relative to second opening 94 and second end 95 may be inserted into a mouth 19 of receptacle 20. This allows for a quantity of treated sand 12 to be poured from container 50 into refilling implement 90 at first end 93 and deposited into the interior 24 of receptacle 20. Of course, it should appreciated by the ordinarily skilled person that a variety of different constructions for refilling implement 90 are contemplated by the present invention, and the particular construction used should not be unnecessarily limited to that described herein.

Figure 7:
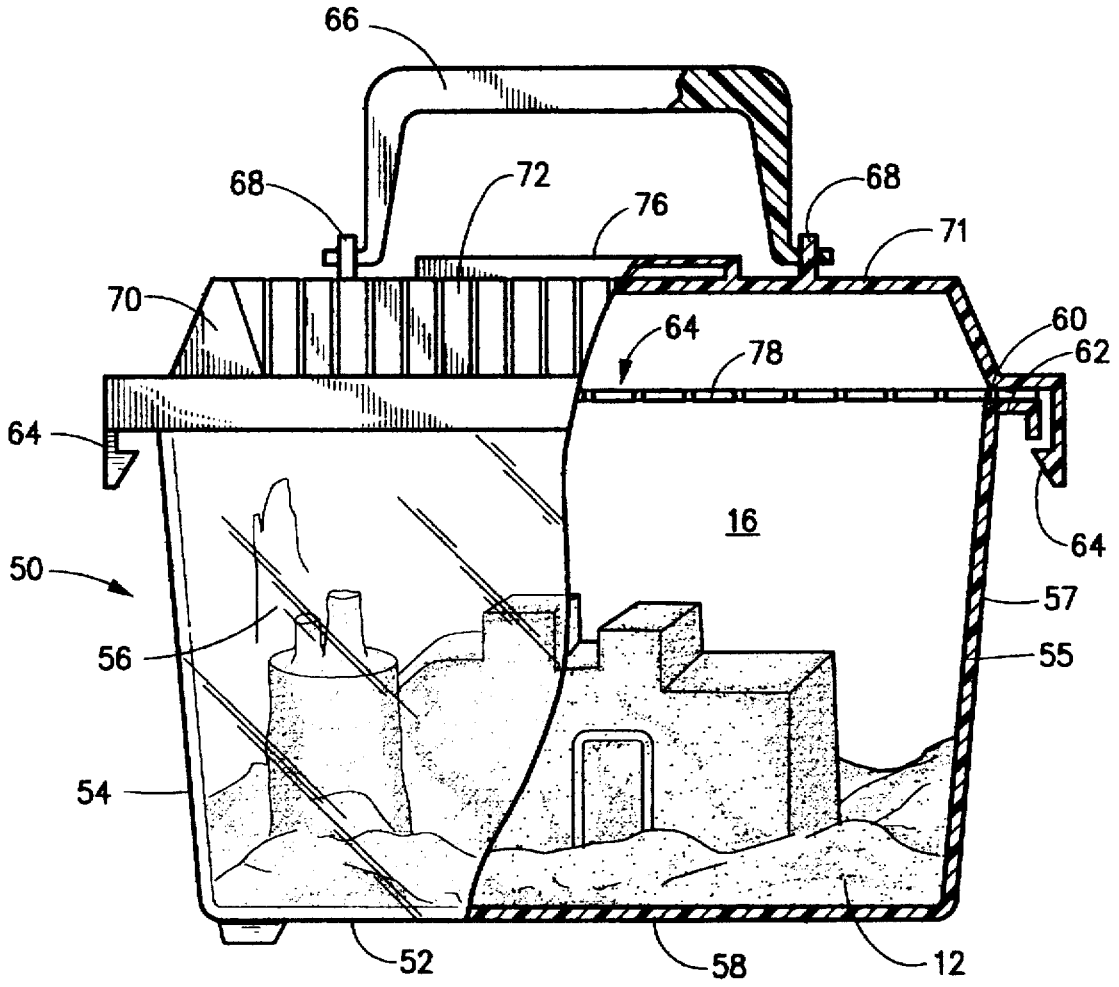
FIG. 7 is a partially cut away side view in elevation of the container in FIG. 5, showing a lid releasably secured thereto and a filter interposed between the lid and the container's mouth.

A desirable construction for container 50, and an alternative approach to draining water 16 therefrom, is shown with reference to FIG. 7. Container 50 is constructed from a transparent material and includes a base 58 which has a generally rectangular perimeter 52. A pair of opposed container end walls 54, 55 and a pair of opposed container sidewalls 56, 57 are disposed on base 58 and project upwardly therefrom to terminate at a rim 60 which defines an opening 64 for container 50. Each of end walls 54, 55 and sidewalls 56, 57 is upwardly divergent from its associated one of the pair so that container 50 has a generally tapered construction.

A lid 70 serves as a covering for container 50 and is releasably securable to container 50 by snaps 64 which operate to releasably engage an outer protruding lip 62 disposed along rim 60. Lid 70 includes a handle 66 for convenient transportation, which handle is pivotally mounted to an upper surface 71 of lid 70 by spaced apart handle mounts 68. A transparent viewing portion 76 is disposed on upper surface 71 so that the contents of treated sand 12 within container 50 may be viewed therethrough. A plurality of drain openings 72 are also provided in lid 70.

In order to conveniently drain water 16 from container 50 without draining the treated sand 12 located therein, a filter 78 is provided. Filter 78 can be a conventional household paper towel as discussed above with reference to FIG. 5, or filter 78 may be a panel member formed of a flexible mesh material which is sized and adapted to be placed between container 50 and lid 70 to cover opening 64. Filter 78 is impervious to the treated sand so that when the water 16 and the treated sand 12 are disposed within container 50, container 50 may be inverted and the water drained therefrom, through filter 78 and drain openings 72, while retaining the treated sand 12 within container 50.

Figure 8:
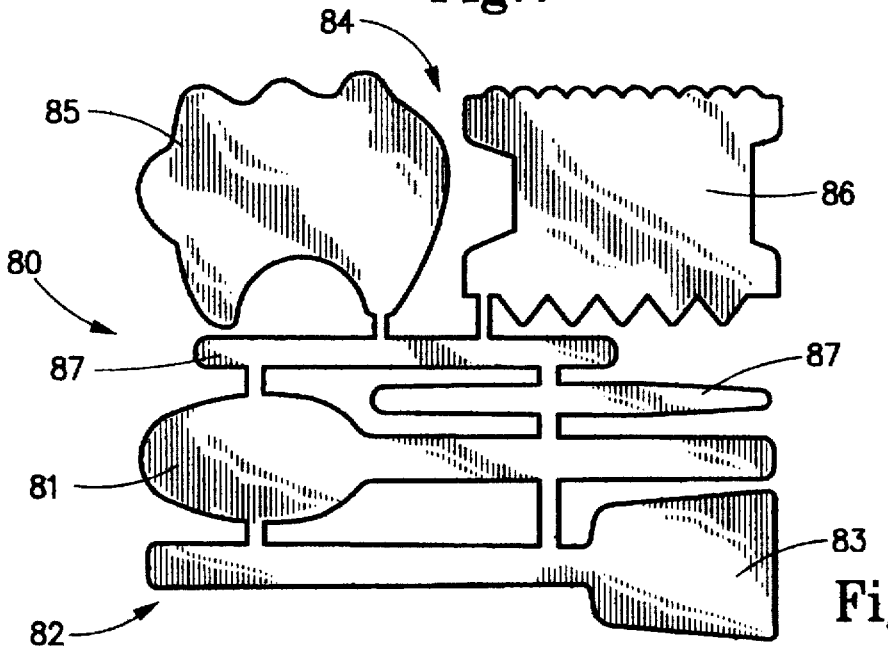
FIG. 8 is a side view of an interconnected tree arrangement for an ensemble of sculpting tools according to the present invention.

While the tapered construction and severability of nozzle 30 would be adequate to form shapes and features of a general nature, it may be inadequate to sculpt more detailed forms. Accordingly, a tool ensemble 80 is provided and is best shown in FIG. 8. Here, tool ensemble 80 includes a set of scooping elements 82 in the form of a spoon 81 and a shovel 83. A set of shaping elements 84 is also provided. This set of shaping elements 84 includes at least two different types of tools for sculpting at least two different types of features—a curved tool 85 and a jagged tool 86. It should be appreciated that scooping elements 82 are useful in manipulating larger masses of treated sand 12, while shaping elements 84 are useful in sculpting intricate designs therein. Scooping elements 82 and shaping elements 84 are releasably connected together by branch members 87 so that they present a flat, tree arrangement. FIG. 8 only illustrates a sample selection for tool ensemble 80 and it should be understood that other types and shapes for the tools, such as knives, etc., may also be used as desired.

Figure 9:
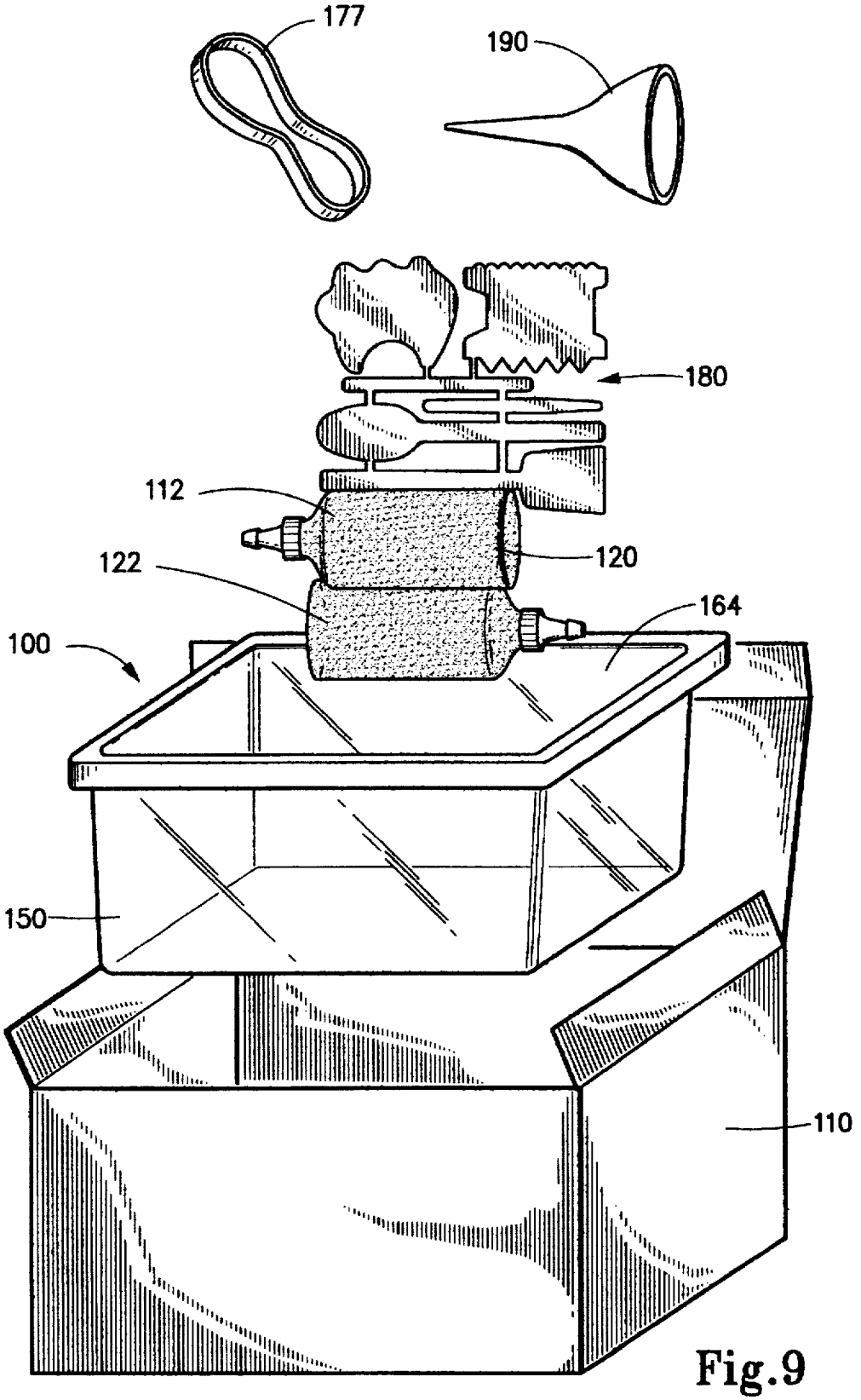
FIG. 9 is an exploded perspective view showing various implements which may comprise a first exemplary embodiment of a sculpting kit according to the present invention.
Figure 10:
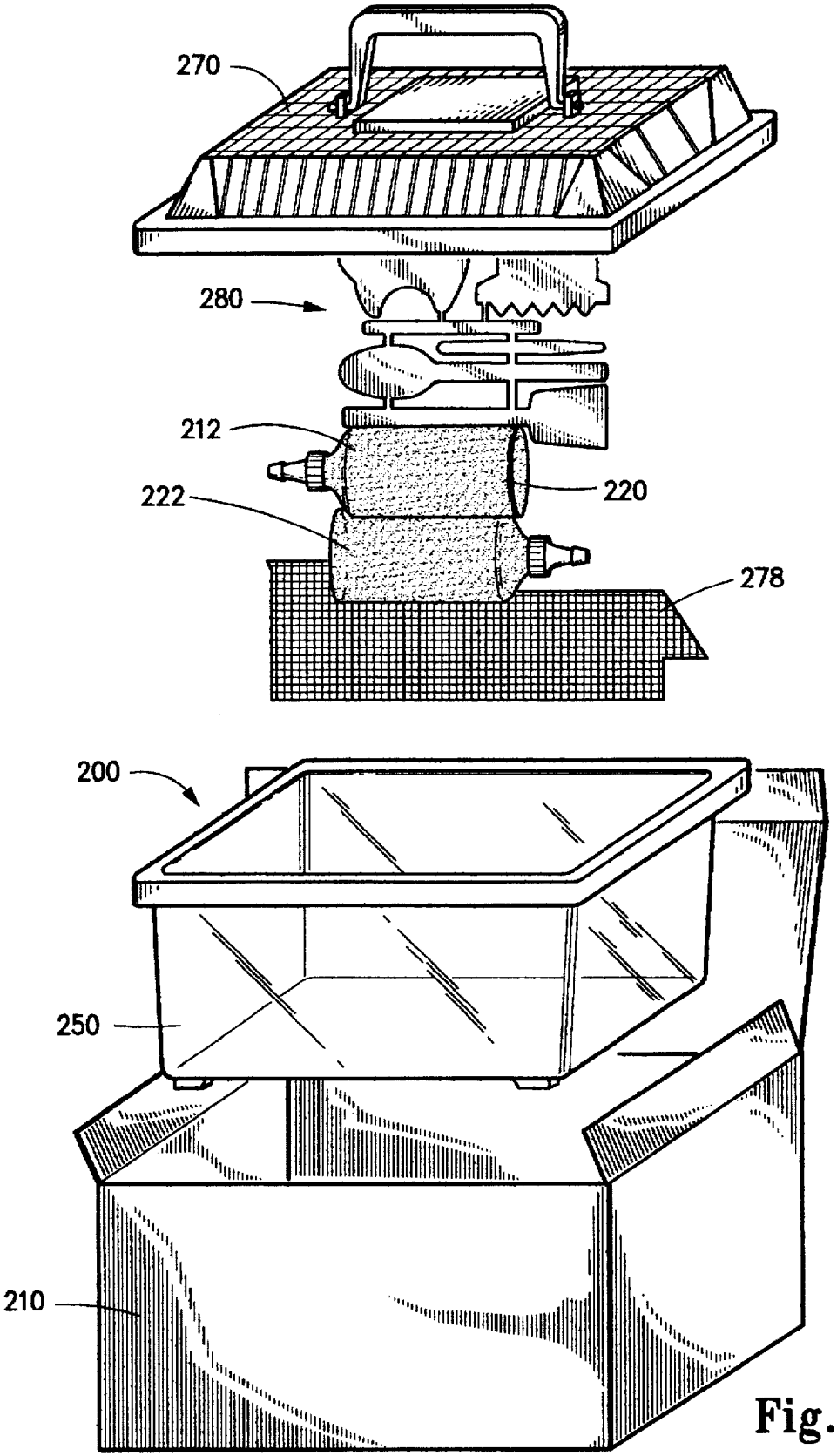
FIG. 10 is an exploded perspective view showing the various implements comprising an alternative exemplary embodiment of the sculpting kit according to the present invention.

FIGS. 9 and 10 illustrate two possible sculpting kits according to the present invention. It should be understood, however, that other configurations for the sculpting kits shown are contemplated, and modifications could certainly be made without departing from the scope of the invention described herein.

With initial reference then to FIG. 9, the individual elements described above may be conveniently packaged as a sculpting kit 100. Sculpting kit 100 may include, by way of illustration only, a plurality of receptacles 120, 122 for storing different colors of treated sand 112, refilling implement 190, tool ensemble 180 and a continuous loop elastic member 177 (shown as a rubber band). Each of these components of sculpting kit 100 is sized for insertion into container 150, and container 150 and its contents can then be stored in an appropriate packaging box 110. As mentioned previously, elastic member 177 is used to secure a filter over container 150's opening 164 to allow for drainage of water therefrom. An appropriate filter may be either provided with sculpting kit 100 or added later by the user.

The individual elements discussed herein may also be conveniently packaged as a sculpting kit 200, as shown in FIG. 10. In the interest of conserving space, it is desirable that filter 278 (shown folded onto itself), tool ensemble 280 and one or more receptacles 220, 222 for containing different colors of treated sand 212 be sized for insertion into container 250. Lid 270 is then secured to container 250 and the entire container and its contents may be inserted into an appropriate packaging box 210. The generally tapered construction for container 250, as noted above with reference to FIG. 7, allows container 250 and its contents to be conveniently received within packaging 210 with little difficultly.

In order to use sculpting kits 100 or 200, then, the individual elements are removed from the container and the container is filled to a desired level with water. A receptacle having a desired color of treated sand is then selected and its nozzle is immersed below the surface level of the water and the receptacle's sidewall is squeezed to extrude a cohesive mass of the treated sand into the container. One or more of the sculpting tools from the tool ensemble may then be chosen to shape the treated sand into a desired form or feature. Different colors of treated sand 12 can be added and sculpted in the same manner. When the child is finished playing, the provided filter, or an appropriate equivalent, may be placed over the container's opening and secured thereto by an elastic member as shown in FIG. 5 or a lid as shown in FIG. 7. The entire container and its contents may then be turned upside down to drain off the water through the filter, leaving only the treated sand (completely dry at this point) in the container. Any left over treated sand can be returned to its proper receptacle for reuse. Finally, the individual components are inserted back into the container, and the entire sculpting kit and its contents may be conveniently stored for use again at a later time.

With the foregoing discussion in mind with reference to the product and kit according to the present invention, it may be appreciated that the present invention also contemplates a methodology of sculpting shapes and features out of sand which is treated so as to retain its cohesiveness when submerged in water that is stored in a container. Broadly, this methodology includes the steps of providing at least one compressible receptacle for the sand, as described above with reference to FIGS. 1–4, immersing the receptacle's nozzle below the surface level of the water, and thereafter squeezing the receptacle's sidewall to extrude a cohesive mass of treated sand through the nozzle in the downstream direction and into the water. Additionally, the methodology may include the step of manipulating the cohesive mass of treated sand into a sculpted shape through the application of a sculpting tool and/or the step of draining the water from the container through the use of a filter which is impervious to the treated sand. Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiments of the present invention without departing from the inventive concepts contained herein.

I claim:

1. A product adapted for use in creating sculpted shapes and features, comprising:

(a) a dry quantity of granular sand which is treated to retain its cohesiveness when submerged in water, said sand having a granular size; and (b) a compressible receptacle containing said dry quantity of granular sand in a hollow interior thereof, said receptacle including a longitudinally extending sidewall surrounding the interior, a closure forming an upstream end of said receptacle and a dispensing nozzle disposed at a downstream end of said receptacle, said nozzle having a mouth sized to be larger than the granular size of said sand and being in fluid communication with the interior, said sidewall fabricated of a flexible material having sufficient flexibility to allow said receptacle to be squeezed with enough force to cause a cohesive mass of said granular sand to be forcibly extruded out of said mouth when said nozzle is immersed within a volume of water.

2. A product according to claim 1 wherein said nozzle extends longitudinally and is tapered in a longitudinal direction, said nozzle being severable thereacross transversely at selected different locations thereby to allow formation of mouths of different cross-sectional areas and to permit said cohesive mass be dispensed with different cross-sections.

3. A product according to claim 1 wherein said sidewall is formed of a material that has sufficient flexibility such that said receptacle is compressible from an original state to a collapsed state wherein opposed inner surfaces of said sidewall contact one another, said receptacle thereafter returnable to the original state without violating structural integrity of said sidewall.

4. A product according to claim 1 wherein said sidewall is an elongated member with said upstream end being elliptical in cross-section.

5. A sculpting kit adapted for use in creating sculpted shapes and features, comprising in combination:

(a) a container adapted to receive and to retain a volume of water;

(b) a first compressible receptacle having a hollow interior and including a longitudinally extending sidewall surrounding said interior, a closure forming an upstream end of said receptacle and a dispensing nozzle formed at a downstream end of said receptacle and in fluid communication with said interior;

(c) a quantity of treated sand of a first color, which treated sand retains its cohesiveness when submerged in water, said treated sand initially disposed in the interior of said first receptacle, said sidewall fabricated from a flexible material such that, when said nozzle is immersed within a volume of water, said first receptacle is adapted to be squeezed thereby to dispense a cohesive mass of said treated sand through said nozzle in a downstream direction and into the water; and (d) a filter formed of a flexible mesh material which is sized and adapted to be placed over an opening of said container, said filter impervious to said treated sand so that when water and said treated sand are disposed in said container, the water may be drained from said container through said filter while retaining said treated sand within said container.

6. A sculpting kit according to claim 5 wherein said container is constructed of a transparent material and includes a base having a generally rectangular perimeter, a pair of opposed container end walls and a pair of opposed container sidewalls which project upwardly from said base to terminate at a rim to form an opening for said container.

7. A sculpting kit according to claim 6 wherein each of said pair of container end walls and container sidewalls is upwardly divergent from one another.

8. A sculpting kit according to claim 5 including a continuous loop elastic member which is sized to extend completely around said container.

9. A sculpting kit according to claim 8 including an ensemble of tools suitable for sculpting a variety of different features in said treated sand.

10. A sculpting kit according to claim 9 wherein said ensemble of tools includes at least two different types of tools for sculpting at least two different types of features.

11. A sculpting kit according to claim 9 wherein said tools are releasably connected together in a generally flattened arrangement.

12. A sculpting kit according to claim 9 including a refilling implement for transferring said treated sand from said container back into said receptacle after use, said refilling implement including a first opening located at a first end thereof and a second opening located at a second end thereof, said first opening enlarged relative to said second opening and in fluid communication therewith and said second opening sized for insertion into a mouth of said receptacle so that said treated sand may be poured from said container through said refilling implement and into the interior of said receptacle.

13. A sculpting kit according to claim 12 including at least a second compressible receptacle having a hollow interior and a longitudinally extending sidewall surrounding said interior so that said treated sand of a second color different from said first color may be disposed in said interior, said second receptacle further including a closure forming an upstream end of said second receptacle and a dispensing nozzle formed at a downstream end of said second receptacle and in fluid communication with said interior.

14. A sculpting kit according to claim 13 wherein said first receptacle, said second receptacle, said filter said elastic member, said tools and said refilling implement are sized for insertion into said container.

15. A sculpting kit according to claim 5 including a lid which is releasably securable to said container.

16. A sculpting kit according to claim 15 wherein said lid includes a plurality of drain openings formed therethrough, said filter adapted to be placed between container and said lid to cover an opening of said container thereby to permit the water to be drained from said container through said filter and said lid while retaining said sand within the container.

17. A sculpting kit according to claim 15 wherein said container includes an outwardly protruding lip disposed along said rim and wherein said lid is adapted to snap fit onto said lip to releasably secure said lid to said container.

18. A sculpting kit according to claim 15 wherein said lid includes a viewing portion to allow said treated sand to be viewed therethrough.

19. A sculpting kit according to claim 5 including an ensemble of tools suitable for sculpting a variety of different features in said treated sand.

20. A sculpting kit according to claim 19 wherein said ensemble of tools includes at least two different types of tools for sculpting at least two different types of features.

21. A sculpting kit according to claim 19 wherein said tools are releasably connected together in a generally flattened arrangement.

22. A sculpting kit according to claim 5 including at least a second compressible receptacle having a hollow interior and including a longitudinally extending sidewall surrounding said interior so that said treated sand of a second color different from said first color may be disposed in said interior, said second receptacle further including a closure forming an upstream end of said second receptacle and a dispensing nozzle formed at a downstream end of said second receptacle and in fluid communication with said interior.

23. A method of sculpting shapes and features out of a quantity of granular sand having a granular size, wherein said sand retains its cohesiveness when submerged in water that is stored in a container, comprising the steps of:

(a) providing at least one compressible receptacle containing a dry quantity of said granular sand, said receptacle having a hollow interior defined by a flexible surrounding sidewall and including a mouth sized to be larger than the granular size and forming a downstream end of said receptacle, and including a closure forming an upstream end thereof and a dispensing nozzle extending outwardly from said receptacle at the downstream end and having a flow passageway in fluid communication with said interior;

(b) immersing said nozzle below a surface level of the water; and (c) squeezing said sidewall with sufficient force to cause a cohesive mass of said granular sand to. be extruded through said nozzle in the downstream direction and into the water.

24. The method according to claim 23 further including the step of manipulating the cohesive mass of said granular sand into a sculpted shape through the application of a sculpting tool.

25. The method according to claim 23 to further including the step of filtering the water from said container while retaining said granular within said container.

* * * * *